US005410782A

United States Patent [19]

Holyoake

[11] Patent Number: 5,410,782

[45] Date of Patent: May 2, 1995

[54] CLIP DEVICE FOR SUPPORTING A PANEL

[75] Inventor: Scott N. Holyoake, Auckland, New Zealand

[73] Assignee: Holyoake Industries Limited, Auckland, New Zealand

[21] Appl. No.: 219,212

[22] Filed: Mar. 29, 1994

[51] Int. Cl.[6] ..... E04B 1/38

[52] U.S. Cl. ..... 24/505; 52/506.06; 52/507; 52/509; 454/292

[58] Field of Search ..... 52/489.1, 768, 769, 52/773, 506.06, 302.1, DIG. 1, 213, 509; 24/502, 504, 505, 508; 454/292

[56] References Cited

U.S. PATENT DOCUMENTS

| | | | |
|---|---|---|---|
| 1,983,022 | 9/1928 | Bulbeck | 52/489.1 |
| 2,837,991 | 6/1958 | De Roo | 454/292 |
| 3,956,805 | 5/1976 | Stroh | 24/505 |

FOREIGN PATENT DOCUMENTS

| | | | |
|---|---|---|---|
| 954604 | 12/1949 | France | 24/508 |
| 1509153 | 4/1969 | Germany | 52/489.1 |
| 911071 | 11/1962 | United Kingdom | 52/489.1 |

*Primary Examiner*—Carl D. Friedman
*Assistant Examiner*—Laura A. Saladino
*Attorney, Agent, or Firm*—Abelman, Frayne and Schwab

[57] ABSTRACT

A clip device for locating an object such as a diffuser in an aperture in a panel comprises a mounting member, a pivotal member, a spring for retaining the pivotal member in either of a first position and second position, and an actuating device comprising a rod and lug whereby the pivotal member can be moved form the first position to the second position. The rod is moveable between an operative condition wherein an end protrudes so as to contact the ceiling panel during insertion of the diffuser in the aperture, and an inoperative condition wherein the end is retracted. The clip can thus be selectively set so as not to operate when the diffuser is installed in the aperture.

12 Claims, 4 Drawing Sheets

CLIP DEVICE FOR SUPPORTING A PANEL

TECHNICAL FIELD

This invention relates to a clip device.

For convenience only, the invention will predominantly be described as a clip device for supporting a panel for maintaining an object in position in an opening of a panel such as a ceiling or wall panel, for which the invention may be particularly suitable. However it is to be understood that it is not to be limited as such. Moreover because the invention may have many other applications, the prior art and possible applications of the invention discussed below are given by way of example.

BACKGROUND ART

Conventional clip devices for locating an object in an opening generally comprise a mounting member whereby the clip device is mounted to the object to be located by the clip device, and a movable member which is movable between a first position and a second position, and is positively held in either of said positions by a suitable holding means. Generally the holding means comprises a device such as a spring loaded over centre mechanism. With such clip devices designed for locating an object in an opening of a panel, triggering of the over centre mechanism generally occurs while the object is being placed into position in the aperture of the panel, and with movement of the movable member past the over centre condition, the spring force assists in drawing a rim of the object towards the panel, thereby firmly holding the rim in position against the panel.

Once in position, it is generally difficult to remove the object since the clip device is designed to firmly hold it in position. Removal generally requires pulling on the object to cause the movable latch members of the dip device to pivot against the spring force and pass through the over centre condition, thereby releasing the catch and allowing the object to be removed. The force involved in this operation may be considerable, especially where the clip device is designed to hold an object very firmly. This makes removal difficult, and the force applied by the dip device to the panel surface may cause damage thereto.

Although the above type of clip device may be satisfactory for most applications where the positioning of the object is a once off operation, its use is inconvenient for cases where the object must be inserted in a trial situation, and removed for adjustment. A typical case may be with ceiling and wall diffuser vents where ducting behind the diffuser must be checked for clearances and alignment with the diffuser positioned in its final position flush with the wall or ceiling panel. In this case it is necessary to first hold the diffuser temporarily in its final position, and then remove the diffuser to make any necessary adjustments. The diffuser may then be permanently installed and held in position with a suitable holding device. With conventional clip devices, the temporary positioning may not be possible since positioning of the diffuser flush with the ceiling or wall panel may result in the over centre mechanism of the clip device operating to cause the diffuser to be securely held in position by the clip device. Hence, removal for any adjustment or alignment may only be possible with great difficulty, and the portions of the panel against which the clip device bears may be damaged.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a clip device for locating an object in an aperture in a panel and against a front surface thereof, said clip device comprising:

means for mounting said clip device on said object, a pivotal member having an engaging surface for engagement with a rear surface of said panel adjacent said aperture, said pivotal member being pivotally supported on said mounting means so as to be pivotal relative to said mounting means between a first position, wherein said engaging surface is retracted from engagement with a peripheral surface of said panel adjacent said aperture when said object is being positioned in said aperture, and a second position wherein said engaging surface is extended so as to be engageable with said rear surface when said object is positioned in said aperture, means for retaining said pivotal member in either of said first and second positions, and means for actuating said pivotal member from said first position to said second position, said actuating means comprising a selection member which is moveable between an operative condition wherein a portion of said selection member protrudes into a field of operation of said actuating means, and an inoperative condition wherein a portion of said selection member is retracted from said field of operation of said actuating means.

According to another aspect of the present invention there is provided a method of installing an object in an aperture formed in a panel using a clip device substantially as described above, comprising the steps of:

(i) setting said selection member to an inoperative condition wherein said actuating means is not operated to move said pivotal member to the second position when said object is positioned in the aperture, (ii) moving the object and clip device into position in the aperture, (iii) removing the object from the aperture, and (iv) setting said selection member to an operative condition wherein said actuating means is operated when said object is moved into said aperture, and (v) reinserting said object into said aperture so that said actuating means is operated, causing said pivotal member to move from said first position to said second position, wherein the engaging surface of said pivotal member engages with a rear surface of said panel thereby positioning said object fixedly in said aperture.

With such a clip device provided on an object to be located in an aperture of a panel, the selection member may be set to an inoperative condition so that the pivotal member of the clip is not moved to the second position when the object is positioned in the aperture. The object may thus be checked in position and easily removed for any required adjustment and alignment etc. The selection member may then be set to an operative condition so that on re-inserting the object in the aperture, the actuating means is operated causing the pivotal member to move to the second position and be held therein by the retaining means, thereby positively locating the object in the panel aperture.

The mounting means may comprise a mounting member which forms part of the clip and which is provided with means for attachment to the object to be located. Alternatively, the mounting means may be formed integral with the object. The pivotal support may comprise any suitable means such as a pivot pin connecting between the pivot member and the mounting means, or a socket and complimentary protrusion member which is arranged to be pivotally supported by the socket.

Any suitable means may be used for retaining the pivotal member in either the first or second position. For example, a spring loaded retaining means may be used which maintains the pivotal member in the engaged condition due to a resilient force. In one embodiment; this may comprise a spring member acting between the pivotal member and the mounting member, with the pivot point of the pivotal member positioned such that the line of force of the spring member may lie on either side of the pivot point. That is to say, the line of force may be on one side for the first position, and on the other side for the second position, in a similar arrangement to an over-centre mechanism.

The actuating means for moving the pivotal member from the first position to the second position may comprise any suitable mechanism or device. For example, this may incorporate an intermediate member linked to said pivotal member, such that movement of the selection member moves the intermediate member and causes the pivotal member to move from the first position to the second position. Alternatively, the actuating means may comprise an intermediate member which is integrally formed as part of the pivotal member. However, any other arrangement or mechanism whereby the pivotal member may be moved from the first to the second position may be possible.

The selection member for optionally selecting operation of the actuating means may comprise a member linked to the pivotal member, and movable between an operative and an inoperative condition. In the operative condition, the selection member may protrude so that movement of the object to which the clip device is attached, into an aperture to which the object is to be fitted may result in the selection member extending into a field of operation of the actuating means wherein the selection member may engage with a peripheral surface of the aperture and thereby cause the actuating means to move the pivot member towards the second position. In the inoperative condition, the selection member is moved out of the field of operation of the actuating means so that the selection member is not contacted when the object is fitted into the aperture. The selection member however is not limited to the above described selection member, and any suitable means whereby operation of the actuator may be optionally selected may be possible.

In one embodiment, the selection member may comprise a selection member pivotally connected to the mounting member with the pivotal connection also acting as the pivotal connection between the pivot member and the mounting member. With the selection member in the operative condition, a portion of the selection member may rest on a portion of the pivotal member so that movement of the selection member in one direction is transmitted to the pivot member, thereby causing the pivot member to pivot about the pivot point and thus to pivot to the second position and be held therein by the resilient force of the retaining member.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

Figure 1:
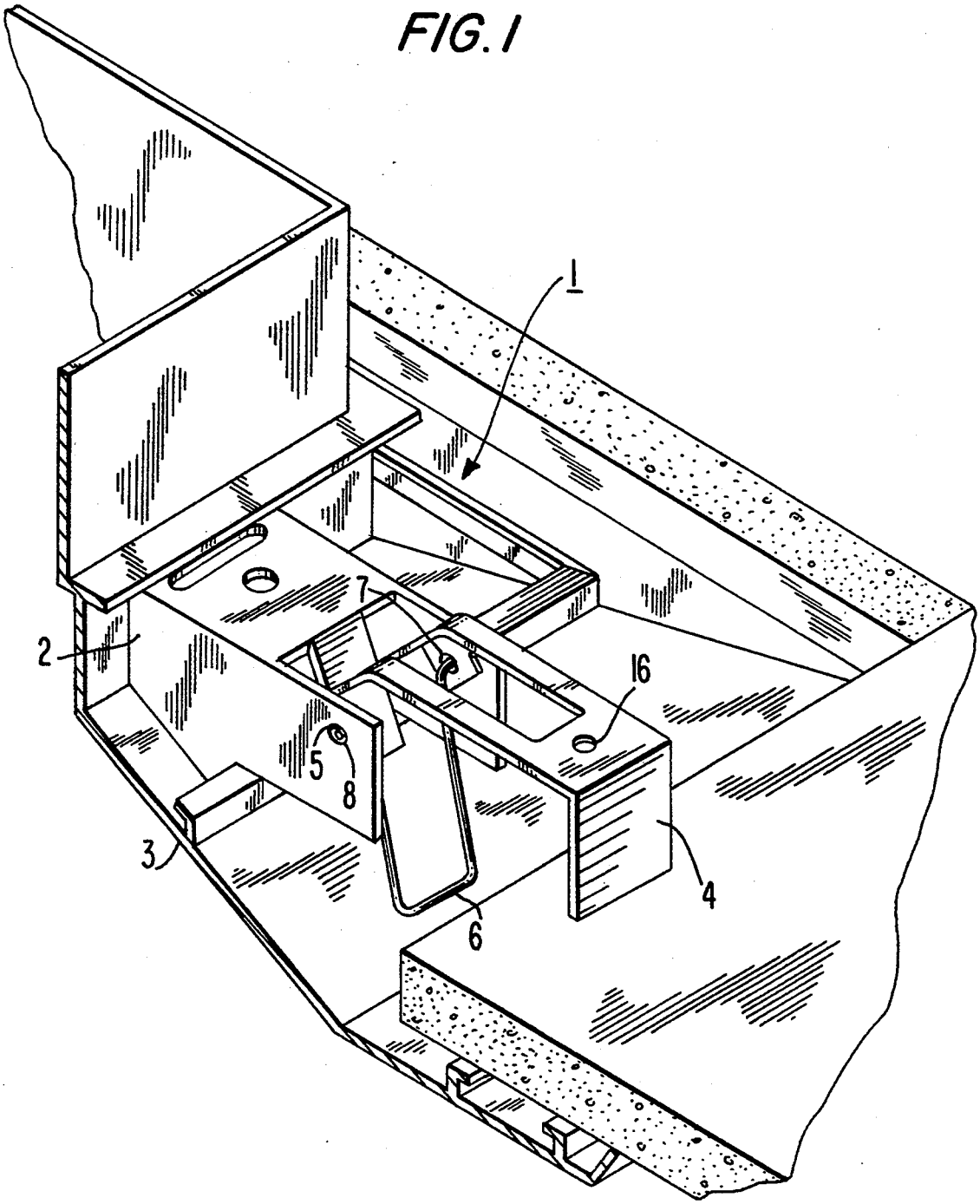
FIG. 1 is a perspective view of a clip device according to a first embodiment of the present invention, with the clip device mounted on a diffuser grill installed in a ceiling panel.
Figure 2:
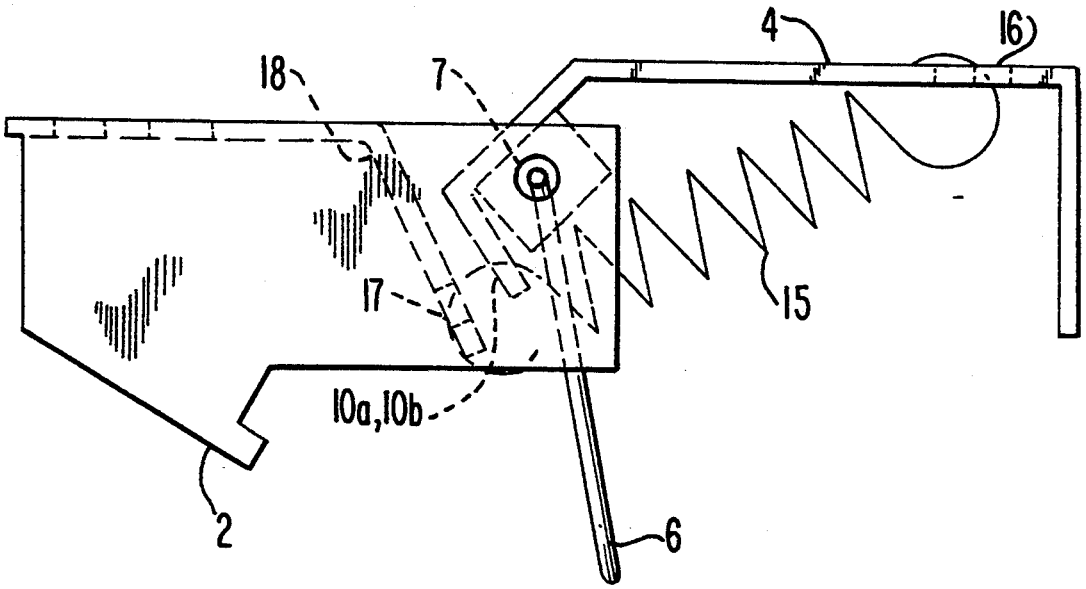
FIG. 2 is an elevation view of the clip device of FIG. 1 in an engaged condition.
Figure 3:
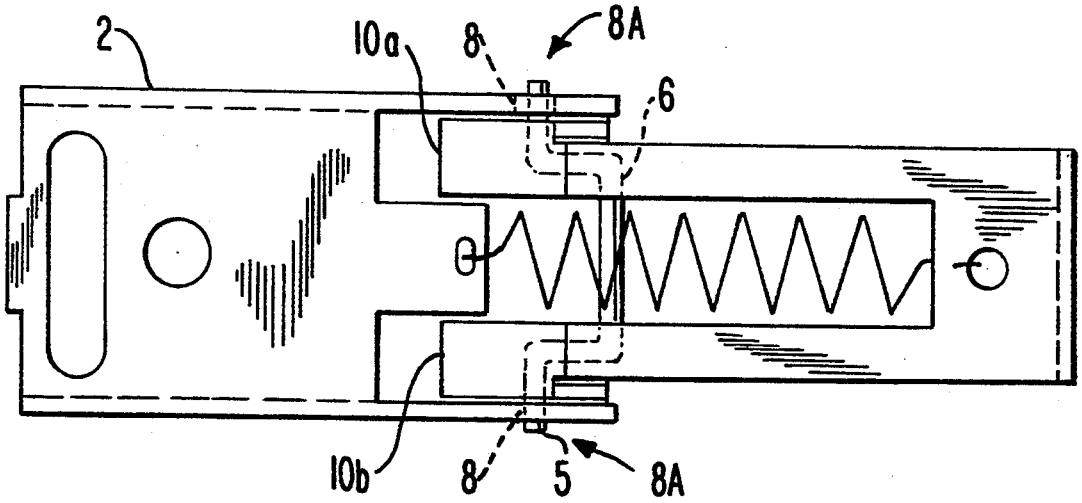
FIG. 3 is a plan view of the clip device of FIG. 2.

With reference to FIG. 1 through FIG. 5, there is shown a clip device according to a first embodiment of the present invention generally indicated by arrow 1. The clip device 1 comprises a mounting member 2 which is removably fitted to an extruded portion of a ceiling diffuser 3. A pivotal member 4 comprising an L-shaped tip section and mounting lugs 5' is pivotally connected to the mounting member 2 by pin portions 5 formed on the end of a U-shaped rod member 6, and which pass through holes 7 in the lugs 5' and holes 8 in the mounting member 2. The rod member 6 acts as a selection member of an actuating device for actuating the pivotal member 4 and is also pivotally connected to the mounting member 2 by the pin portions 5. The holes 7, and 8 and the pin portions 5 of the rod member 6 thus constitute a pivot connection, having a pivot point generally indicated by arrow 8A, for the pivotal member 4 and the rod member 6 relative to the mounting member 2.

Figure 4:
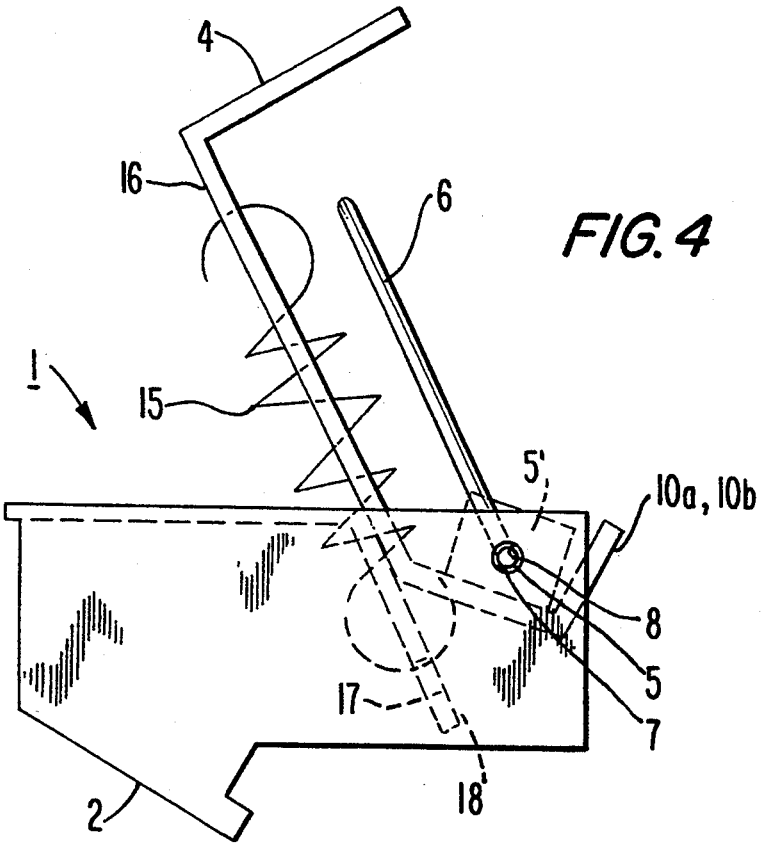
FIG. 4 is an elevation view of the clip device of FIG. 1 in a retracted and inoperative condition.
Figure 5:
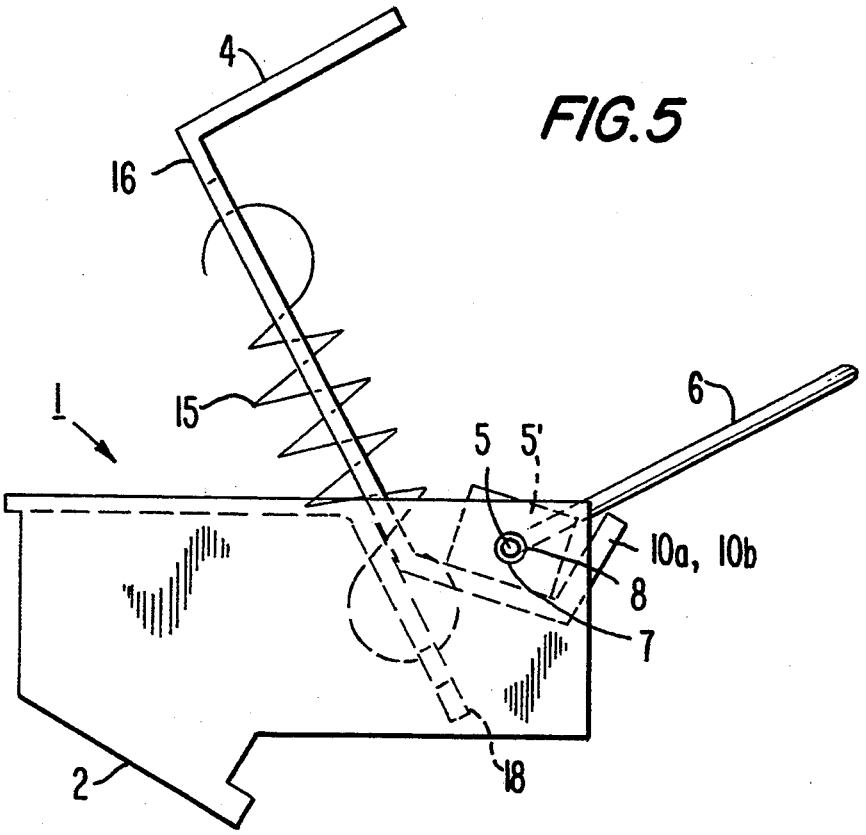
FIG. 5 is an elevated view of the clip device of FIG. 1 in a retracted and operative condition.

As shown more clearly in FIG. 4, the pivotal member 4 is further provided with arms **10*a*, 10*b* formed as extensions of the pivotal member 4 on either side of the pivotal member 4, and bent at approximately 90° to the end portion of the pivotal member 4. These arms 10*a*, 10*b* act as intermediate members forming part of the actuating device whereby the pivotal member 4 may be pivoted about the pivot connection 8A. With clockwise (in FIGS. 1 to 5) pivotal movement of the rod member 6 about the pivot 8A, the leg sections of the rod member 6 engage with the ends of the arms 10*a*, 10*b* so that further pivotal movement of the rod member 6 causes the arms 10*a*, 10*b* and pivotal member 4 to pivot in a clockwise direction about the pivot point 8A**.

The clip device 1 is also provided with a retaining device in the form of a spring 15 connected between a hole 16 formed in the pivotal member 4, and a hole 17 formed in a lug member 18 of the mounting member 2. The arrangement of the holes 16 and 17 in relation to the pivot point 8A is such that the spring 15 may exert a retaining force on the pivotal member 4 with the pivotal member 4 in either of two positions. In the first position corresponding to a retracted condition (FIGS. 4 and 5), the axis of operation of the spring is on one side of the pivot point 8A, while in the second position (FIG. 2) corresponding to an engaged condition, the axis of operation is on the other side of the pivot point 8A.

With the pivotal member 4 in the first position (FIG. 4), the rod member 6 may be swung upwards to lie parallel with a central portion of the pivotal member 4. This corresponds to the inoperative condition of the actuating device. The end of the rod member 6 in this condition is out of the field of operation of the actuating device. That is to say, the diffuser 3 may be moved into position in the ceiling panel without the rod member 6 contacting the peripheral portion of the aperture of the ceiling panel.

With the pivotal member 4 still positioned in the first position, the rod member 6 may be swung down to the operative position (FIG. 5) wherein it protrudes outwards from the mounting member 2 and rests on the end of the arms 10*a*, 10*b*. In this position, the end of the rod member 6 protrudes into a field of operation of the actuating device. That is to say, in moving the ceiling diffuser 3 into the aperture of the ceiling panel, the end of the rod member 6 may engage with the ceiling panel so that the rod member 6 is forced downwards. As a result it bears against the arms 10*a*, 10*b* and causes the pivotal member 4 to pivot about the pivot 8A in a clockwise direction. The spring 15 is thus moved past the pivot point centre so as to urge the pivotal member 4 into the engaged position, wherein it presses against the back surface of the ceiling panel and holds the ceiling diffuser 3 firmly in position as shown in FIG. 1.

Figure 6:
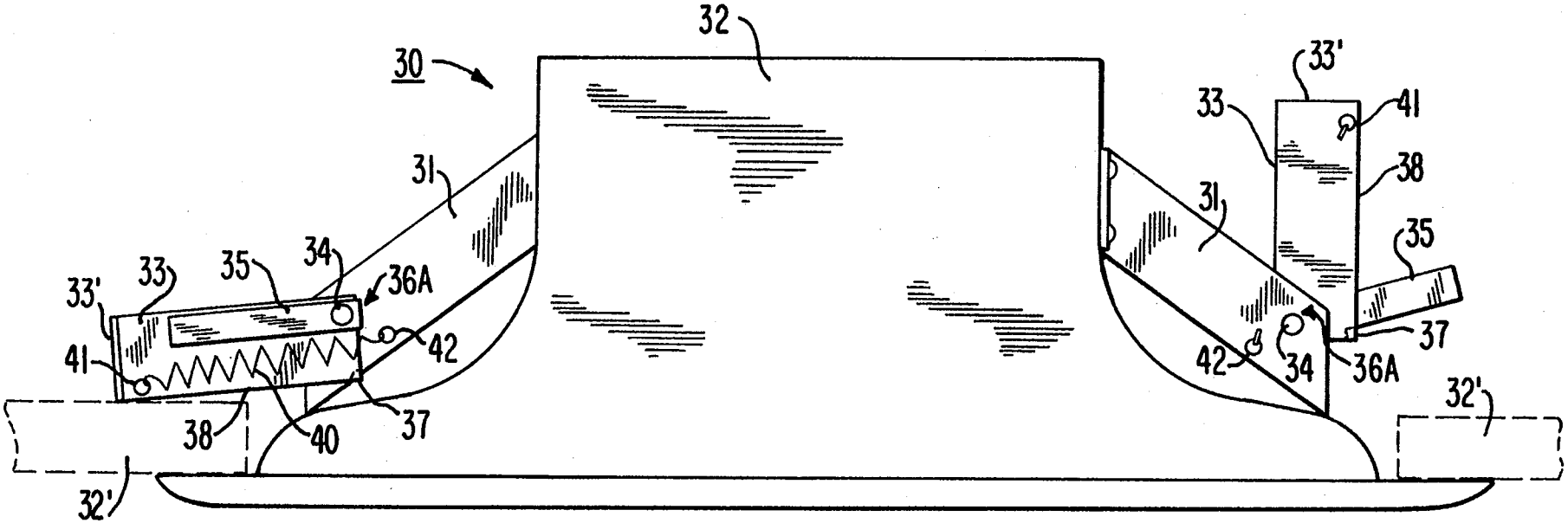
FIG. 6 is an elevation view of a clip device according to a second embodiment of the present invention mounted on a diffuser and shown in two configurations, one being a retracted and operative condition and one being an engaged condition.

With reference to FIG. 6, there is shown a clip device according to a second embodiment of the present invention generally indicated by arrow 30. In FIG. 6, the clip device 30 is shown in two configurations, the configuration on the right of FIG. 6 being a retracted and operative condition, and the configuration on the left of FIG. 6 being an engaged condition. The clip device 30 comprises a mounting member 31 which is fixedly attached to a neck portion of a ceiling diffuser 32 (shown in relation to a ceiling panel 32' shown in dotted outline). A pivotal member 33 in the form of a flat elongated plate with one end 33' thereof bent at 90° for rigidity and to provide an engaging surface, is pivotally connected at an opposite end to the mounting member 31 by a rivet pin 34 which passes through complimentary holes in the mounting member 31 and the pivotal member 33. The rivet pin 34 also provides a pivotal connection for a rod member 35 which is thereby pivotally connected at one end thereof, relative to both the pivotal member 33 and the mounting member 31. In assembling the pivotal member 33, and rod member 35 to the mounting member 31, the rivet pin 34 is inserted through the respective pivotal mounting holes, and the pin end of the rivet pin 34 then swaged over. With this arrangement, the rod member 35 acts as a selection member of an actuating device for actuating the pivotal member 33, and the rivet pin 34 provides a pivotal connection having a pivot point generally indicated by arrow 36A, for pivotally connecting the pivotal member 33 and the rod member 35 relative to the mounting member 31.

The pivotal member 33 is also provided with a lug 37 which is formed by cutting into an edge 38 of the pivotal member 33 at an incline and bending the edge portion so as to protrude from a plane of the pivotal member 33. In this case the angle of the cut is such as to provide a suitable seat for the rod member 35 when the rod member 35 is orientated relative to the pivotal member 33 as shown on the right hand side of FIG. 6. The lug 37 (intermediate member) thus acts in combination with the rod member 35 as an actuating device whereby the pivotal member 33 may be pivoted about the pivot connection 36A. With downwards movement of the rod member 35 about the pivot 36A, the lower face of the rod member 35 engages with the lug 37 so that further pivotal movement of the rod member 35 causes the lug 37 and pivotal member 33 to pivot downwards about the pivot point 36A.

The clip device 30 is also provided with a retaining device in the form of a spring 40 connected between a hole 41 formed in the pivotal member 33, and a hole 42 formed in the mounting member 31. The arrangement of the holes 41 and 42 in relation to the pivot point 36A is such that the spring 40 may exert a retaining force on the pivotal member 33 with the pivotal member 33 in either of two positions. In the first position corresponding to a retracted condition (right hand side in FIG. 6), the axis of operation of the spring 40 is on one side of the pivot point 36A, while in the second position (left hand side in FIG. 6) corresponding to an engaged condition with the engaging surface of the end 33' contacting a rear face of the ceiling panel 32', the axis of operation is on the other side of the pivot point 36A.

The operation and function of the clip device is similar to that of the clip device described in FIG. 1 through FIG. 5, with the rod member 35 having the same function as the rod member 6, the pivotal member 33 having the same function as the pivotal member 4, the mounting member 31 being equivalent to the mounting member 2, the lug 37 being equivalent to the arms 10*a*, 10*b*, and the spring 40 being equivalent to the spring 15. Description is therefore omitted for brevity.

Aspects of the present invention have been described by way of example only and it should be appreciated that modifications and additions may be made thereto without departing from the scope thereof as defined in the appended claims.

I claim:

1. A clip device for locating an object in an aperture in a panel and against a front surface thereof, said clip device comprising: means for mounting said clip device on said object, a pivotal member having an engaging surface for engagement with a rear surface of said panel adjacent said aperture, said pivotal member being pivotally supported on said mounting means so as to be pivotal relative to said mounting means between a first position wherein said engaging surface is retracted from engagement with a peripheral surface of said panel adjacent said aperture when said object is being positioned in said aperture, and a second position wherein said engaging surface is extended so as to be engageable with said rear surface when said object is positioned in said aperture, means for retaining said pivotal member in either of said first and second positions, and means for actuating said pivotal member from said first position to said second position, said actuating means comprising a selection member which is moveable between an operative condition wherein a portion of said selection member protrudes into a field of operation of said actuating means, and an inoperative condition wherein a portion of said selection member is retracted from said field of operation of said actuating means.

2. A clip device as claimed in claim 1, wherein said selection member is pivotally connected relative to said mounting means, and is engageable with said pivotal member by pivotal movement relative to said mounting means.

3. A clip device as claimed in claim 2, wherein the pivotal connection of said selection member, and the pivotal connection of said pivotal member comprises a single pivot pin.

4. A clip device as claimed in claim 2, wherein the pivotal connection of said selection member, and the pivotal connection of said pivotal member comprises a rod portion formed on said selection member.

5. A clip device as claimed in claim 2, wherein said selection member comprises a rod member, and the pivotal connection of said selection member and the pivotal connection of said pivotal member comprises rod portions formed at opposite ends of said rod member.

6. A clip device as claimed in claim 1, wherein said mounting means comprises a mounting member, which is provided with means for attachment to said object.

7. A clip device as claimed in claim 1, wherein said retaining means comprises an over-centre mechanism, with a resilient member acting between the pivotal member and the mounting means, and a pivot point of said pivotal member is positioned such that a line of force of said resilient member may lie on either side of said pivot point.

8. A clip device as claimed in claim 7, wherein said resilient member is a spring.

9. A clip device as claimed in claim 1, wherein said actuating means comprises an intermediate member linked to said pivotal member, the arrangement and construction being such that movement of said selection member moves the intermediate member and causes said pivotal member to move from said first position to said second position.

10. A clip device as claimed in claim 9, wherein said intermediate member is integrally formed as part of said pivotal member.

11. A clip device as claimed in claim 10, wherein said pivotal member includes a substantially fiat surface, and said member comprises a portion of said pivotal member which protrudes from a plane of said surface.

12. A method of installing an object in an aperture formed in a panel using a clip device substantially as claimed in claim 1, comprising the steps of:

(i) setting said selection member to an inoperative condition wherein said actuating means is not operated to move said pivotal member to said second position when said object is positioned in said aperture, (ii) moving the object and clip device into position in the aperture, (iii) removing the object from the aperture, and (iv) setting said selection member to an operative condition wherein said actuating means is operated when said object is moved into said aperture, and (v) reinserting said object into said aperture so that said actuating means is operated, causing said pivotal member to move from said first position to said second position, wherein the engaging surface of said pivotal member engages with a rear surface of said panel thereby positioning said object fixedly in said aperture.

* * * * *